US005839040A

United States Patent [19]

Kagayama et al.

[11] Patent Number: 5,839,040

[45] Date of Patent: Nov. 17, 1998

[54] COLOR IMAGE FORMING DEVICE HAVING INTERMEDIATE TRANSFER BODY SANDWICHED BETWEEN IMAGE RECORDING UNITS

[75] Inventors: Shigeru Kagayama, Owariasahi; Osamu Nagata, Aichi-ken, both of Japan

[73] Assignee: Brother Kogyo Kabushiki Kaisha, Nagoya, Japan

[21] Appl. No.: 863,188

[22] Filed: May 27, 1997

[30] Foreign Application Priority Data

May 27, 1996 [JP] Japan ..... 8-131756

[51] Int. Cl.[6] ..... G03G 15/01

[52] U.S. Cl. ..... 399/302; 347/55; 399/298

[58] Field of Search ..... 399/297, 298, 399/299, 300, 302, 308; 347/55

[56] References Cited

U.S. PATENT DOCUMENTS 4,935,788 6/1990 Fantuzzo et al. ..... 399/299
4,987,455 1/1991 Lubberts ..... 399/299
5,257,046 10/1993 Schmidlin ..... 347/55 X
5,353,050 10/1994 Kagayama .
5,477,250 12/1995 Larson ..... 347/55
5,552,814 9/1996 Maeda et al. .
5,623,719 4/1997 De Cock et al. ..... 399/299

FOREIGN PATENT DOCUMENTS

A 2-297570 12/1990 Japan .
A 5-124248 5/1993 Japan .

*Primary Examiner*—Sandra L. Brase
*Attorney, Agent, or Firm*—Oliff & Berridge, PLC

[57] ABSTRACT

In order to make a color image forming device compact in size, two color recording units are disposed in one side of an intermediate transfer body and another two color recording units are disposed in opposite side thereof. The two recording unit in each side are aligned vertically in close proximity to the intermediate transfer body which has a surface on which color toner image is deposited by the respective recording units. The toner image is then transferred onto and thermally fixed on an image recording medium.

19 Claims, 6 Drawing Sheets

COLOR IMAGE FORMING DEVICE HAVING INTERMEDIATE TRANSFER BODY SANDWICHED BETWEEN IMAGE RECORDING UNITS

BACKGROUND OF THE INVENTION

1. Field of the Invention

The present invention relates to an image forming device, specifically, an image forming device including a plurality of image recording units for forming a color image.

2. Description of Related Art

There have been proposed different kinds of image forming devices. For example, Japanese Laid-Open Patent Publication (Kokai) No. HEI-2-297570 describes an electrostatic image forming device including; a modulating electrode member; a toner supply means; a control unit; an image recording unit formed with a drive circuit; and an back electrode. The modulating electrode member has: an flexible insulation sheet formed with a plurality of apertures; and control electrodes formed on the insulation sheet, each control electrode provided so as to surround the edge of a corresponding aperture. The toner supply means is disposed on a side of the modulating electrode unit opposite the side confronting the recording medium. The toner supply means supplies negatively charged toner to the control electrodes from the side opposite to the recording medium. The control unit is connected to the control electrodes of the modulating electrode member and, based on an image signal, selectively supplies an energization energy to the control electrodes via the drive circuit. The back electrode is disposed on the side of the modulating electrode member opposite to the toner supply means and near the control electrodes.

When the control unit supplies an energization energy to each of the control electrodes, an electric field is generated between the control electrode and the back electrode. Then, toner supplied on a toner transposing roller flows through the selected apertures toward the recording medium, thereby forming image dots on the recording medium.

Japanese Laid-Open Patent Publication (Kokai) No. HEI5-124248 describes a tandem type image forming device using three image recording units to form a color image. Each image recording unit stores one of three color toner, that is, either yellow toner, magenta toner, or cyan toner. The image recording units are aligned at a predetermined interval in a sheet feeding direction along a sheet feed pathway of the recording medium. Four recording units storing yellow toner, magenta toner, cyan toner, and black toner can be used instead of the three recording units.

However, in the tandem type image forming device, because the image recording units are provided juxtaposed in the sheet feeding direction, the device has a long feed pathway and so it is difficult to produce the image forming device in a compact size. This is especially true for a color image device having three or four image recording units because the image recording unit is extremely large in the sheet feeding direction.

SUMMARY OF THE INVENTION

It is an object of the present Invention to solve the above-described problems and to provide a compact-sized image forming device.

To achieve the above and other objects, there is provided, according to one aspect of the invention, an image forming device for forming an image on an image recording medium, that includes a plurality of image recording units and an intermediate medium transfer mechanism. Each image recording unit contains a printing material, which Is typically a toner particle. The intermediate medium transfer mechanism has an intermediate medium on a surface of which the image is deposited by the image recording units. The intermediate medium transfer mechanism transfers the image onto the image recording medium. In the Invention, the transfer mechanism is Interposed between the plurality of image recording units.

Each image recording unit includes a plurality of aperture electrodes formed with a plurality of apertures, and a plurality of control electrodes provided in one-to-one correspondence with the plurality of apertures. Each control electrode allows the printing materials to pass through the corresponding aperture. The intermediate medium transfer mechanism includes a pair of rollers rotatably disposed in a spaced apart relation with each other. The intermediate medium is stretched between the pair of rollers. A thermal fixing roller is further provided which thermally fixes the image transferred onto the image recording medium.

The intermediate medium is in a form of an endless belt stretched between a first roller rotatable about a first axis and a second roller rotatable about a second axis. A part of the plurality of image recording units are disposed at one side of a line connecting the first axis and the second axis and a remaining part of the plurality of image recording units are disposed at another side of the line opposite the one side. Preferably, there are provided four image recording units. The first and second recording units are disposed in and along the one side of the line. The third and fourth recording units are disposed in and along the another side of the line. The first and third recording units are in confrontation with each other with the intermediate transfer mechanism interposed therebetween. Also, the second and fourth recording units are in confrontation with each other with the intermediate transfer mechanism interposed therebetween.

According to another aspect of the invention, there is provided an image forming device for forming an image on an image recording medium, which includes a plurality of image recording units, and an intermediate medium transfer mechanism. Each image recording unit includes an electrode array formed with a plurality of passageways being aligned in a row through which charged printing materials pass. The electrode array has a control electrode with respect to each of the plurality of the passageways. The image recording unit further includes a charged printing material supplier that supplies the printing materials to the passageway. The charged printing material supplier is disposed one side of the electrode array. The image recording unit further includes an electrode drive circuit for selectively supplying a voltage to each of the plurality of the control electrodes. The intermediate medium transfer mechanism is disposed another side of the electrode array. The intermediate medium transfer mechanism has an intermediate medium on which the printing material is deposited. The intermediate medium transfer mechanism transfers the charged printing material onto the image recording medium. The intermediate medium transfer mechanism is disposed between the plurality of image recording units.

Preferably, the intermediate medium is in a form of an endless belt stretched between a first roller and a second roller. The plurality of image recording units are separately disposed In two sides separated by a line along which the first roller and the second roller are aligned. Typically, at lease two image recording units are disposed one side of the intermediate medium transfer mechanism with respect to the line. At least a portion of the intermediate medium is fed in a vertical direction. The image is deposited on that portion of the intermediate medium.

A fixing unit is further provided that thermally fixes the image deposited on the intermediate medium onto the image recording medium.

According to still another aspect of the invention, there is provided an image forming device that includes a plurality of image recording units, and a feeding mechanism. Each image recording unit contains a printing material for forming an image on a recording medium. The feeding mechanism feeds the recording medium in a first direction and then in a second direction opposite the first direction upon turning around at an extreme. The image recording units are sandwiched between the recording medium.

BRIEF DESCRIPTION OF THE DRAWINGS

The particular features and advantages of the invention as well as other objects will become more apparent from the following description taken in connection with the accompanying drawings, in which: accompanying drawings, in which.

DETAILED DESCRIPTION OF THE PREFERRED EMBODIMENTS

Figure 1:
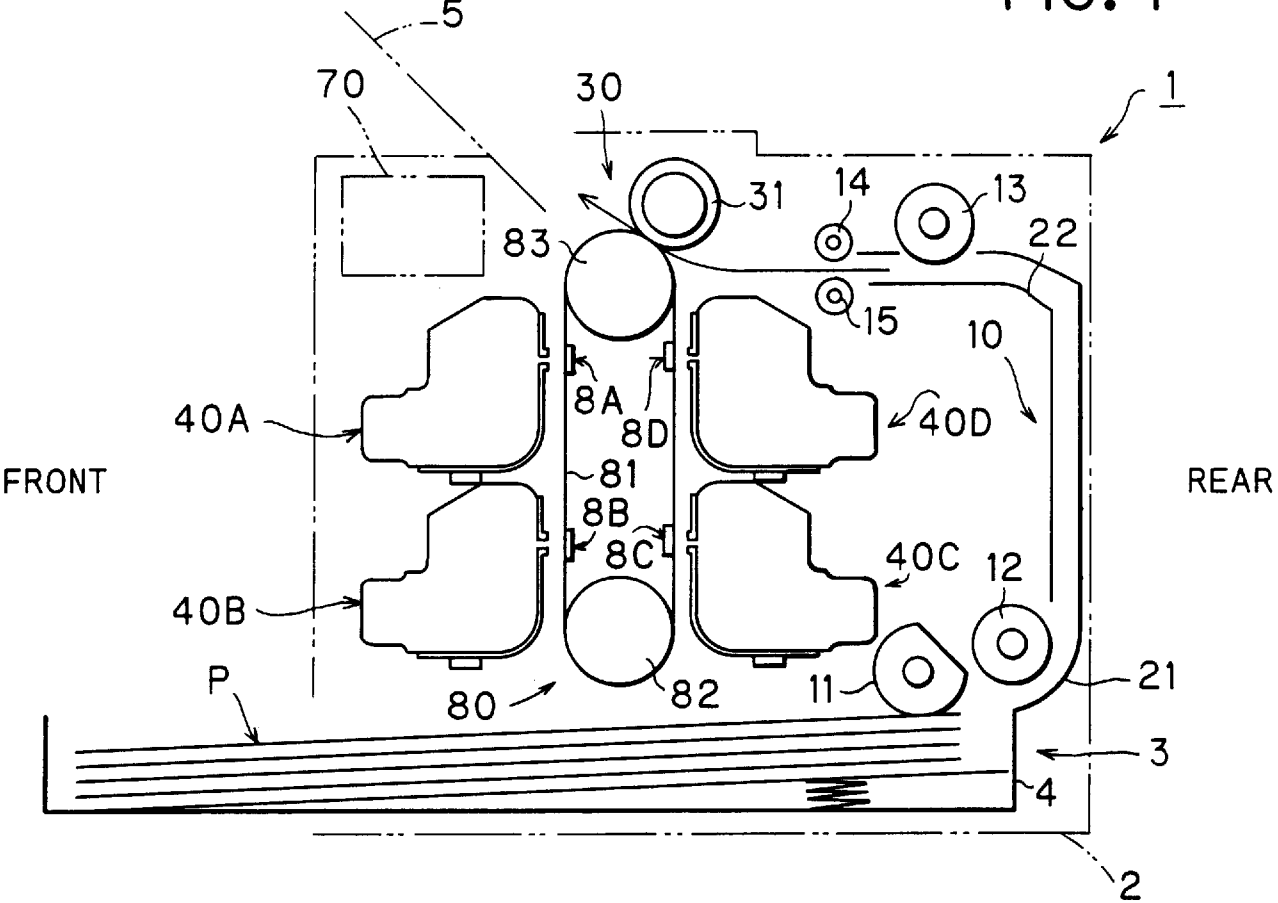
FIG. 1 is a schematic view showing internal configuration of an image forming device according to an embodiment of the present invention.

An image forming device according to a preferred embodiment of the present invention will be described while referring to the accompanying drawings wherein like parts and components are designated by the same reference numerals to avoid duplicating description. In the following description, the expression "vertical" is used throughout the description to define the various parts when the image forming device is disposed in an orientation in which it is intended to be used.

FIG. 1 shows an image forming device 1 according to an embodiment of the present invention for forming a color image on a paper sheet P. As shown in FIG. 1, a main frame 2 is provided for housing: a sheet cassette housing portion 3; a sheet feed unit 10; a fixing unit 30; four image recording units 40A~40D; four back electrodes 8A~8D; a transfer unit 80 including an intermediate transfer body 81; and a control unit 70.

The cassette housing portion 3 is disposed in a lower portion of the main frame 2. A sheet cassette 4 storing a number of paper sheets P is mounted on the cassette housing portion 3. A discharge tray 5, on which a sheet P with an image developed thereon is discharged, is provided at an upper portion of the main from 2.

The feed unit 10 includes a sheet supply roller 11, feed rollers 12–15, sheet guides 21, 22, and a roller drive unit (not shown in the drawings) all disposed along a sheet feeding pathway along witch a paper sheet P from the sheet cassette 4 is fed, first, from the front to the rear of the device, and then, upward. The fixing unit 30 includes a heat roller 31 and a pressing roller 83, both rotatably disposed at the upper center of the main frame 2. A halogen lamp is disposed in the heat roller 31.

Figure 2:
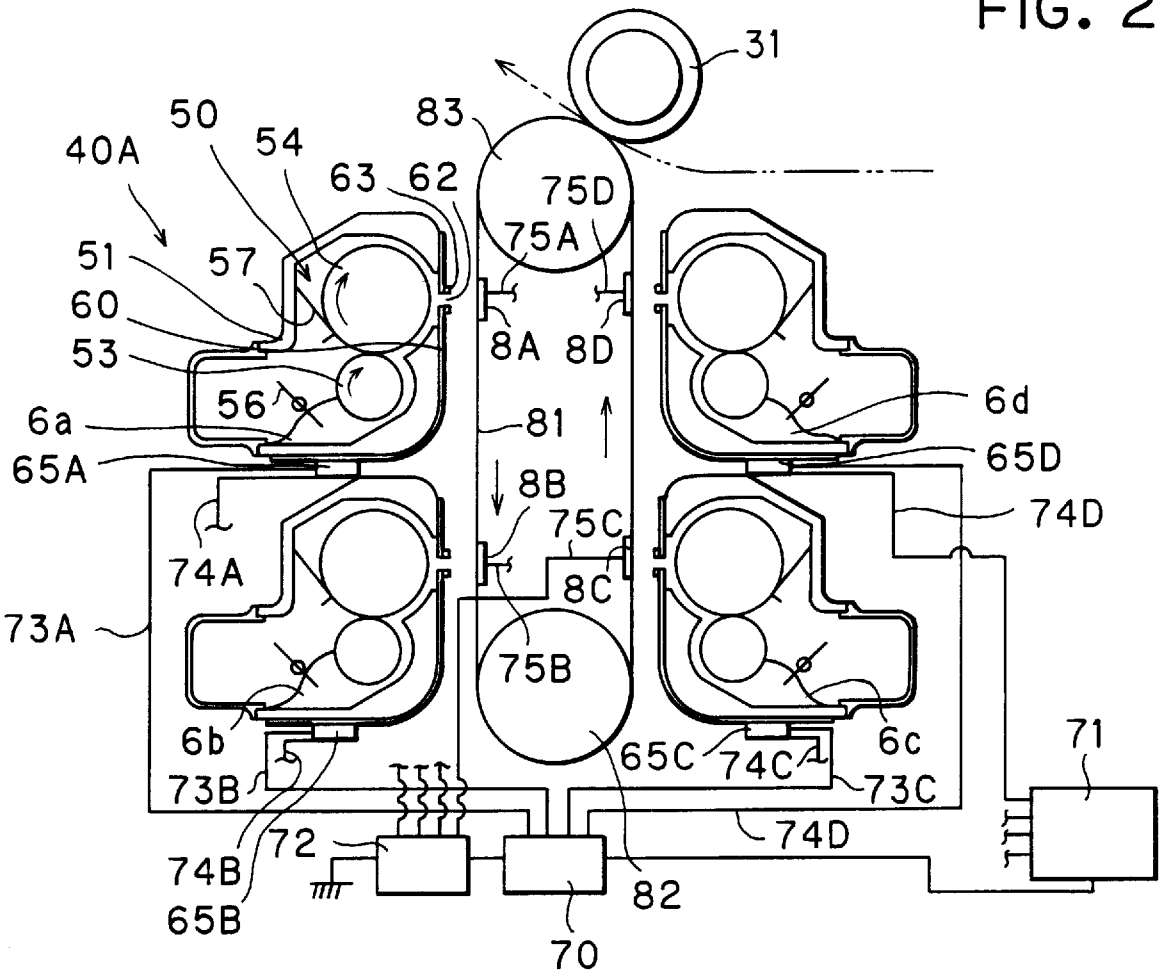
FIG. 2 is a schematic view showing further detail of the internal configuration of FIG. 1.

As shown in FIG. 2, each of the image recording units 40A–40D is provided with one of four color toner, that is, yellow toner 6*a* for recording yellow pixels, magenta toner 6*b* for recording red pixels, cyan toner 6*c* for recording blue pixels, and black toner 6*d* for recording black pixels, respectively. These toner 6*a*–6*d* serves as recording materials and charged particles of the present invention. The image recording units 40A, 40B and the image recording units 40C, 40D are symmetrically arranged on either side of a vertical axis of the transfer unit 80, thereby sandwiching the transfer unit 80 between themselves.

Each back electrode 8A–8D is provided adjacent to a corresponding one of the image recording units 40A–40D with the intermediate transfer body 81 sandwiched between itself and the corresponding one of the image recording units 40 *a*–40D.

Next, an explanation will be provided for the transposing unit 80 while referring to FIG. 2. A drive roller 82 is rotatably provided at the lower center of the main frame 2. The intermediate transfer body 81 is wound around the drive roller 82 and the pressing roller 83 so as to pass beside the back electrodes 8A–8D. The intermediate transfer body 81 is an endless belt formed from a resin film, such as polyimide or polyester, or a metal, such as nickel or stainless steal. The intermediate transfer body 81 is coated at its surface with a coating layer of fluorine or silicon so that the toner will cling to the intermediate transfer body 81 with sufficient tenacity.

When a motor (not shown in the drawings) rotates the drive roller 82, the intermediate transfer body 81 is fed in a direction indicated by arrows shown in FIG. 2. The pressing roller 83 rotates in accordance with rotation of the drive motor to feed the intermediate transfer body 81 while applying pressure thereto. As shown in FIG. 2, the two image recording units 40A, 40B are provided at one side of the intermediate transfer body 81 and the other image recording units 40C, 40D are provided at another side with respect to a direction perpendicular to a direction in which the drive roller 82 and the pressing roller 83 are aligned.

The intermediate transfer body 81 is stretched in the vertical direction forming a flat surface on which the image recording units 40A–40D form an image. The intermediate transfer body 81 bends to conform to the outer peripheries of the drive roller 82 and the pressing roller 83.

Said differently, the intermediate transfer body 81 is fed by the drive roller 82 to bend along the periphery of the drive roller 82 starting from a bending start point, and to straighten out starting from a bending end point. Therefore, it can be said that the image recording units 40A, 40B are located at a downstream side of the bending start point and the image recording units 40C, 40D are located at an upstream side of the bending end point.

Next, an explanation will be provided for the image recording units 40A–40D while referring to FIG. 2. Because the configurations of the image recording units 40A–40D are identical except for the particular toner 6*a*–6*d* used thereby, detail will be provided for a representative image recording unit 40A to avoid duplicating description.

The image recording unit 40A includes: a toner supply units 50; a modulating electrode member 60; and an integrated circuit 65A disposed on the modulating electrode member 60. The toner supply means 50 is includes: a metal toner case 51; a toner storing portion 52; a toner supply roller 53; a toner transport roller 54; a toner agitator 56; and a toner thickness regulation blade 57. With respect to the horizontal direction, which is perpendicular to the sheet surface of FIG. 2, the toner case 51 is formed to a width that is 2–3cm wider than width of a maximum sized sheet P. The toner supply roller 53, the toner transport roller 54, the toner agitator 56, and the blade 57, which are housed in the toner case 51, are formed to widths that are equal to or larger than the width of the maximum-sized sheet P in the horizontal direction.

The toner supply roller 53 is made from a silicon foam and is rotatably supported about its axis. The toner supply roller 653 is disposed so as to extend into the toner storing portion 52 and so as to contact the toner transport roller 54. When a drive means (not shown in the drawings) rotates the toner supply roller 53 along with the toner transport roller 54 in a direction indicated by arrows shown in FIG. 2, the toner supply roller 53 imparts a negative charge to the toner 6a due to friction and supplies the toner 6*a* to the toner transport roller 54.

The toner transport roller 54 is made from a metal roller member whose outer peripheral surface is coated with a semiconductive film. The toner transport roller 54 is rotatably supported about its axis and is rotated with the toner supply roller 53. The thickness regulating blade 57, which is formed from an insulating material, regulates thickness of a toner layer on the surface of the toner transport roller 54 to predetermined thickness of about 40 to 50 $\mu$m. The drive means rotates the toner agitator 56 at a is low speed to transport the toner 6*a* toward the toner supply roller 53.

Figure 3:
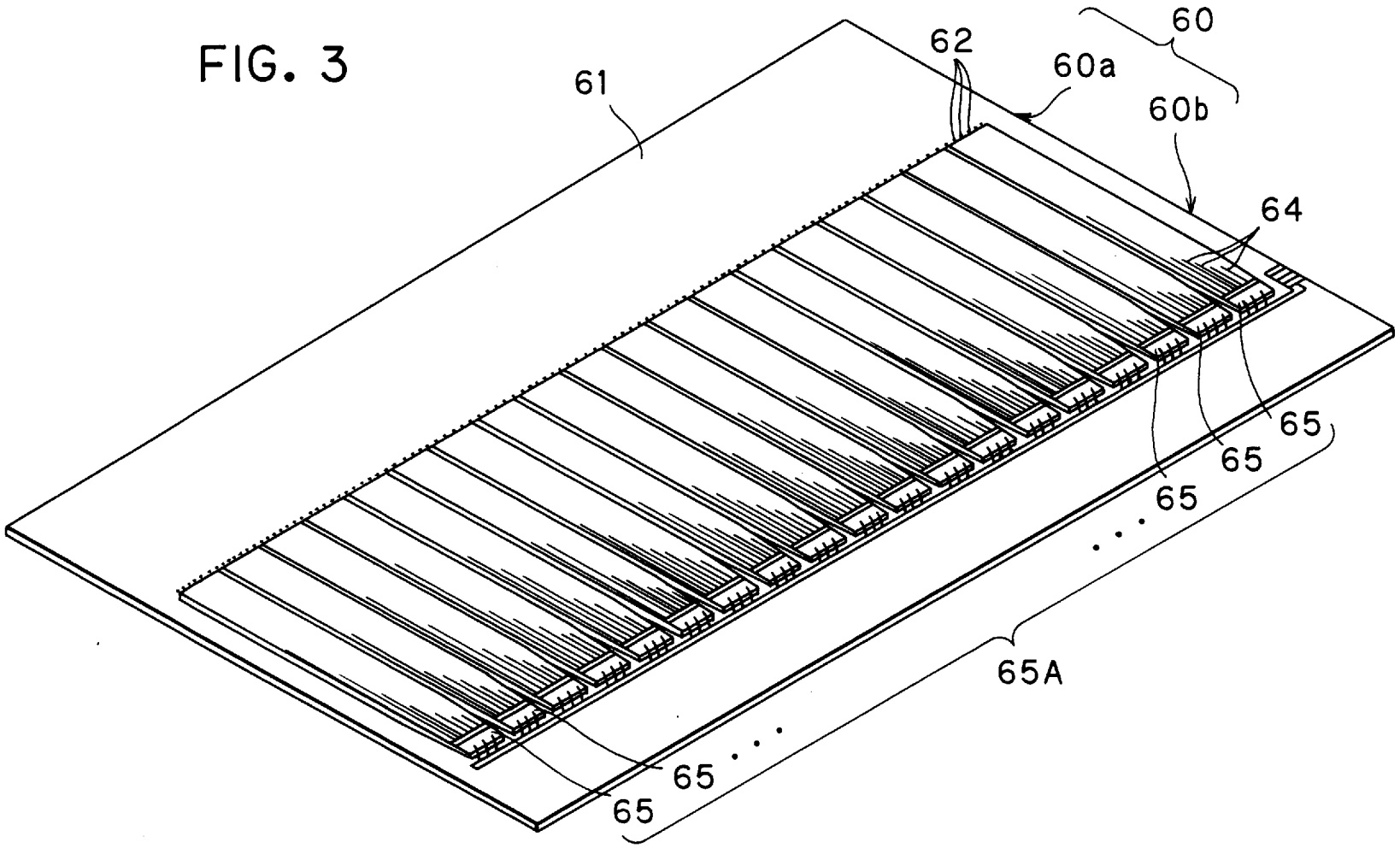
FIG. 3 is a perspective view showing a modulating electrode body of the image forming device.
Figure 4:
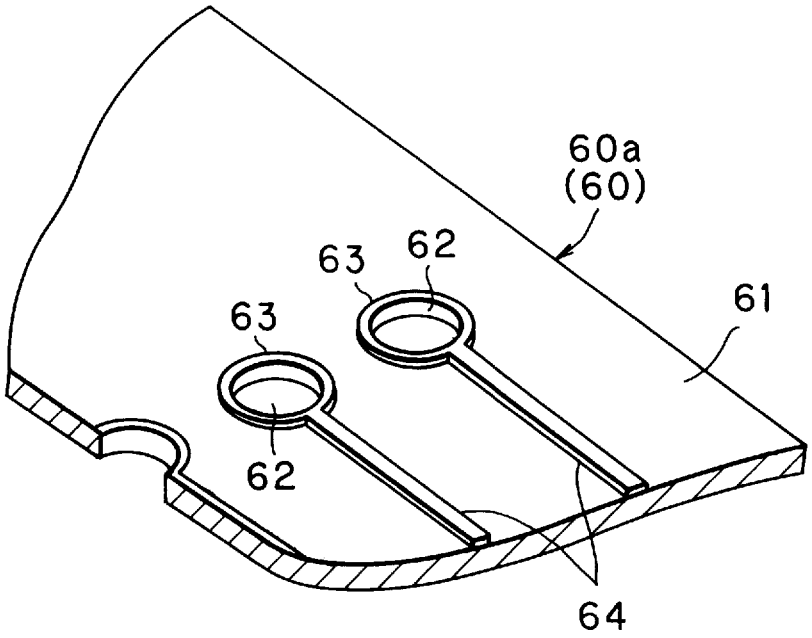
FIG. 4 is a perspective view in partial cross section showing details of the modulating electrode body.

Next, an explanation will be provided for the modulating electrode member 60 while referring FIG. 3 and 4.

The modulating electrode member 60 includes: an insulation sheet 61 formed with a plurality of apertures 62 through which toner 6*a* is to pass; a plurality of control electrodes 63 each surrounding a corresponding aperture 63 as shown in FIG. 4; a plurality of integrated circuit chips 65; and a wiring 64 for connecting the control electrodes with corresponding circuit chips 65. The insulation sheet 61 is made from a synthetic resin such as polyimide, and has a thickness of, for example, 25 $\mu$m. Each control electrode 63 is formed so that an its corresponding aperture. Although not shown in the drawings, the plurality of the control electrodes 63 and the wiring 64 are covered with an insulation layer, which is further covered with the a charge preventing film.

Each aperture 62 has a circular shape with a diameter of, for example, 65 $\mu$m. The plurality of the apertures 62 are arranged in a single row in the horizontal direction with a pitch of, for example, 127 $\mu$m. At this pitch 1700 apertures 62 and 1700 control electrodes 63 are provided for the width of an A4 sized sheet P.

The plurality of the control electrodes 63 and the wiring 64 are formed from copper films formed by etching techniques. In the present embodiment, 19 integrated circuit chips 65 for driving the control electrodes are mounted on one side of the insulation sheet 61. The wiring 64 are divided into 19 groups and connected to the integrated circuit chips 65.

As shown in FIG. 3, the modulating electrode member 60 is divided into a main portion 60*a* and an extended portion 60*b* which extends from the main portion. The main portion 60*a*, which includes the plurality of the apertures 62 and the electrodes 63, is mounted onto the side surface of the toner case 51 so as to be parallel to the surface of the intermediate transfer body 81. On the other hand, the extended portion 60*b*, which is provided with the integrated circuit 65A, is bent upwardly by 90 degrees to the side away from the sheet pathway and is intimately attached to the lower surface of the toner case 51.

Next, an explanation will be provided for a control system of the image recording units 40A–40D while referring to FIG. 2. The control system for controlling the image recording unit 40A–40D includes: a control unit 70 for receiving an image signal from an external device; a driving voltage generating circuit 71 for supplying a driving voltage to the integrated circuits 65A–65D; and a back voltage generating circuit 72 for supplying a predetermined back voltage to the back electrodes 8A–8D. The control unit 70 is electrically connected to the integrated circuits 65A–65D via control wiring 73A–73D, respectively.

The driving voltage generating circuit 71 is capable of generating drive voltages of 0V and +40V and is electrically connected to the integrated circuits 65A–65D via drive voltage wiring 74A–74D. The integrated circuits 65A–65D selectively supply the drive voltage to corresponding control electrodes 63 based on a signal outputted from the control unit 70. That is, the integrated circuits 65A–65D output a drive voltage of +40V for recording and a drive voltage of 0V for not recording.

The toner transporting rollers 54 are connected to ground. The back voltage generation circuit 72 supplies a common back voltage of, for example, +1,000 V to the back electrodes 8A–8D. It should be noted that the drive voltage generation circuit 71 and the back voltage generating circuit 72 are started and stopped based on an ON/OFF signal from the control unit 70.

Figure 5:
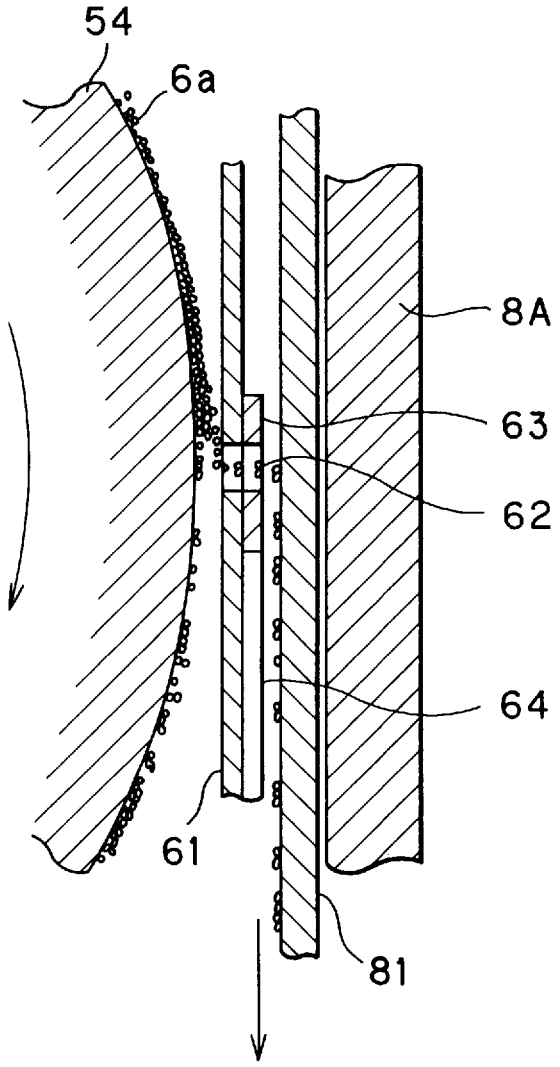
FIG. 5 is a cross-sectional view of the modulating electrode body and surrounding components.

Next, while referring to FIG. 5, an explanation will be provided for the image recording unit 40A and the back electrode 8A as a representative example for the image forming operations of the image recording units 40A–40D and the back electrodes 8A–8D.

The modulating electrode member 60 is disposed to the right side, as viewed in FIG. 5, of the toner transporting roller 54. The negatively charged toner 6*a* adhering in a layer on the surface of the toner transporting roller 54 are transported toward the plurality of the apertures 62 of the modulating electrode member 60 by rotation of the toner transporting roller 54. When the driving voltage generating circuit 71 applies a voltage of +40V to the control electrode 63 shown in FIG. 5, an electric field is generated from the control electrode 63 to the toner transport roller 54. The toner 6*a* flows toward the control electrode 63 due to electrostatic attraction. However, because a stronger electric field is generated from the back electrode 8A to the control electrode 63, the toner 6*a* is further drawn through the aperture 62 toward the back electrode 8A. The toner 6*a* impinges onto the intermediate transfer body 81 traveling between the control electrode 63 and the back electrode 8A. In this way, one image dot is formed. On the other hand, when a voltage of 0V is applied to the control electrode 63, no electric field will be generated so that the toner 6*a* will remain on the surface of the toner transport roller 54. Therefore, no image is formed.

Next, a description will be provided for color image forming operation of the image forming device 1 for forming a color image using the color toner of yellow, magenta, cyan, and black. The control unit 70 controls each of the integrated circuits 65A–65D based on image signals for the yellow, magenta, cyan, and black colored toner. The image recording units 40A–40D are juxtaposed adjacent to the intermediate transfer body 81 at a predetermined spacing in the feeding direction of the intermediate transfer body 81. That is, adjacent image recording units 40A–40D are separated by a predetermined distance in the feeding direction of the intermediate transfer body 81. It will be assumed that a time τ is required for the intermediate transfer body 81 to travel the predetermined distance between adjacent image recording units 40A–40D. Based on image signals, the control unit 70 first outputs a control signal to the integrated circuit 65A, then after elapse of time τ, outputs a control signal to the integrated circuit 65B, then the Integrated circuit 65C, and after elapse of three times time τ, finally to the integrated circuit 65D. A color image is formed on the surface of the intermediate transfer body 81 once one cycle is completed. Then, the toner 6*a* –6*d* forming the color image is transposed and fixed on the surface of the sheet P by the transposing unit 80 and the fixing unit 30.

In the present embodiment, each of the recording units 40 is arranged around the intermediate transfer body 81 as described above. With this configuration, a color image recording device can be manufactured in a much smaller size than can conventional devices having recording units placed in a straight line in a sheet feeding direction.

Because the fixing unit 30 is placed at the upper portion of the device, heat generated by the heat roller 31 can be released out of the device without adversely increasing internal temperature of the device. This enables highly stable recording of images.

Because each of the image recording units 40A–40D forms an image on the vertically extended surfaces of the intermediate transfer body 81, the image recording units 40A–40D can perform recordings stably under uniform conditions. Also, the toner 6*a* –6*d* which flowed toward, but did not impinge on, the intermediate transfer body 81 will fall downward without back onto and undesirably accumulating on the modulating electrode member 60. Further stable recordings can be achieved.

While the invention has been described in detail with reference to specific embodiments thereof, it would be apparent to those skilled in the art that various changes and modifications may be made therein without departing from the spirit of the invention, the scope of which is defined by the attached claims.

Figure 6:
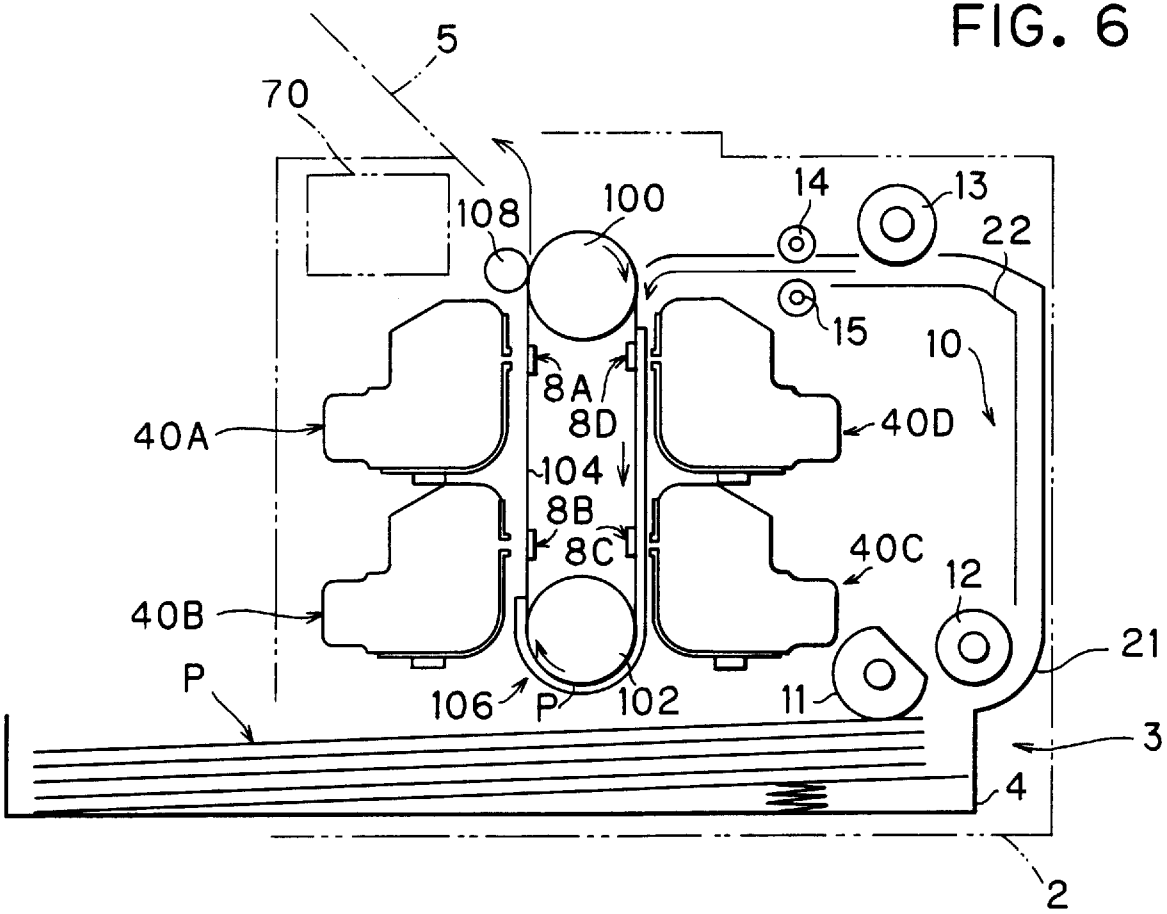
FIG. 6 is a schematic view showing a modification of the image forming device of the first embodiment.

For example, in the above described embodiment, an image is formed on the intermediate transfer body 81, and then, transposed on the sheet P. However, the image can be formed directly on the sheet P without the intermediate transfer body 81. An example of such a configuration will be described while referring to FIG. 6. It should be noted that like members shown in FIGS. 1 and 6 are identified by the same reference numerals to avoid duplicating description. A transport unit 106 is disposed between the image recording units 40A, 40B and 40C, 40D. The transport unit 106 is formed with rotatable rollers 100, 102 and a transport belt 104 wound thereon. The surface of the transport belt 104 is imparted with adhesive properties so that the sheet P will cling thereto. The image recording units 40A–40D form an image directly on the sheet P which is transported on the transport belt 104. Then, a heat roller 108 fixes the image on the sheet P. In this case, the transport unit 106 serves as a transport means, and the sheet P serves as a recording medium of the present invention.

A cylindrical intermediate transfer roller can be used instead of the belt shaped intermediate transfer body 81. In this case, the image recording units are disposed circularly around the periphery of the intermediate transfer roller.

Although four recording units are provided in the present embodiment, the present invention can be applied for any image recording device having two or more recording units. For example, the image recording unit 40D for black toner can be omitted.

To more positively prevent selected control electrodes 63 from recording images, a −40V can be applied to the control electrodes 63 in stead of a voltage of 0V. In this case, an electric field is generated from the toner transport roller 54 to the control electrodes 63. Because the toner will be attracted to the toner transport roller 54 due to electrostatic attraction, the toner will not flow toward the control electrodes 63.

Also, different drive voltages can be applied to each of the image recording units 40A–40D and similarly different back voltages can be applied to each of the back electrodes 8A–8D. Alternatively, one common back electrode can be used instead of four back electrodes 8A–8D.

In the above described embodiment, an image formed on the intermediate transfer body 81 is simultaneously transposed and fixed on the sheet surface by sandwiching the intermediate transfer body 81 between the heat roller 31 and the pressing roller 83. However, transposing and fixing of the image can be performed separately. In this case, the image can be first transposed on the sheet surface and then fixed by providing a separate fixing unit.

In the image recording units 40A–40D described above, the toner 6*a* –6*d* flow through the apertures 62 due to electrostatic attraction. However, the present invention can be applied to any type of image recording unit, such as an ink jet recording unit or a thermal transposing recording unit.

What is claimed is:

1. An image forming device for forming an image on an image recording medium, the image forming device comprising:

a plurality of image recording units, each of said plurality of image recording units containing a printing material; and an intermediate medium transfer mechanism comprising a plurality of back electrodes and an intermediate medium on which the image is deposited by said plurality of image recording units, the intermediate medium being interposed between each back electrode and a corresponding image recording unit, the intermediate medium transfer mechanism transferring the image on the intermediate medium onto the image recording medium, the intermediate transfer mechanism being interposed between said plurality of image recording units.

2. The image forming device according to claim 1, wherein each of said plurality of image recording units comprises a plurality of aperture electrodes formed with a plurality of apertures, and a plurality of control electrodes provided in one-to-one correspondence with the plurality of apertures, each of said plurality of control electrodes allowing the printing material to pass through an aperture of a corresponding aperture electrode.

3. The image forming device according to claim 1, wherein said intermediate medium transfer mechanism comprises a pair of rollers rotatably disposed in a spaced apart relation with each other, said intermediate medium being stretched between said pair of rollers.

4. The image forming device according to claim 3, further comprising a thermal fixing roller that thermally fixes the image transferred onto the image recording medium.

5. The image forming device according to claim 1, wherein the intermediate medium is in a form of an endless belt stretched between a first roller rotatable about a first axis and a second roller rotatable about a second axis, and wherein a part of said plurality of image recording units are disposed at one side of a line connecting the first axis and the second axis and a remaining part of said plurality of image recording units are disposed at another side of the line opposite the one side.

6. The image forming device according to claim 5, wherein said plurality of image recording units comprises a first image recording unit, a second image recording unit, a third image recording unit, and a fourth image recording unit, the first recording unit and the second recording unit being disposed in and along the one side of the line and the third recording unit and the fourth recording unit being disposed in and along the another side of the line.

7. The image forming device according to claim 6, wherein the first recording unit and the third recording unit are in confrontation with each other with said intermediate transfer mechanism interposed therebetween, and the second recording unit and the fourth recording unit are in confrontation with each other with said intermediate transfer mechanism interposed therebetween.

8. An image forming device for forming an image on an image recording medium, the image forming device comprising:

a plurality of image recording units, each of said plurality of image recording units including:

an electrode array formed with a plurality of passageways being aligned in a row through which charged printing materials pass, said electrode array having a plurality of control electrodes with each provided to a respective one of the plurality of the passageways;

a charged printing material supplier that supplies the charged printing materials to the passageway, said printing material supplier being disposed at one side of said electrode array; and an electrode drive circuit for selectively supplying a voltage to each of said plurality of the control electrodes; and an intermediate medium transfer mechanism disposed on another side of said electrode array, said intermediate medium transfer mechanism having a plurality of back electrodes and an intermediate medium on which the charged printing materials are deposited, each back electrode being disposed in confrontation with a corresponding image recording unit, the intermediate medium being interposed between each back electrode and a corresponding image recording unit, said intermediate medium transfer mechanism transferring the charged printing materials on the intermediate medium onto the image recording medium, wherein said intermediate medium transfer mechanism is interposed between said plurality of image recording units.

9. The image forming device according to claim 8, wherein the intermediate medium is in a form of an endless belt stretched between a first roller and a second roller, and wherein said plurality of image recording units are separately disposed on two sides separated by a line along which said first roller and said second roller are aligned.

10. The image forming device according to claim 9, wherein at least two of said plurality of image recording units are disposed on one side of said intermediate medium transfer mechanism with respect to the line.

11. The image forming device according to claim 8, wherein at least a portion of the intermediate medium is fed in a vertical direction, said plurality of image recording units being disposed in confrontation with the at least a portion of the intermediate medium.

12. The image forming device according to claim 11, further comprising a fixing unit that thermally fixes the image deposited on the intermediate medium onto the image recording medium.

13. The image forming device according to claim 8, wherein portions of the intermediate medium are fed straight, said plurality of image recording units being in confrontation with one of the straight portions of the intermediate medium.

14. The image forming device according to claim 8, wherein portions of the intermediate medium are fed in directions parallel with each other.

15. An image forming device comprising:

a plurality of image recording units each for forming an image on a recording medium, the recording medium having a first surface and a second surface opposite from a first surface, wherein each image recording unit forms the image on the first surface of the recording medium; and a feeding mechanism that feeds the recording medium in a first direction and then in a second direction opposite the first direction upon turning around at an extreme, wherein the recording medium is sandwiched between said plurality of image recording units.

16. The image forming device according to claim 15, wherein each of said plurality of image recording units comprises a plurality of aperture electrodes and a plurality of control electrodes provided in one-to-one correspondence with said plurality of aperture electrodes formed with a plurality of apertures, each of said plurality of control electrodes allowing the printing materials to pass through an aperture of a corresponding aperture electrode.

17. The image forming device according to claim 15, wherein said plurality of image recording units comprises a first image recording unit, a second image recording unit, a third image recording unit, and a fourth image recording unit, the first recording unit and the second recording unit being disposed in and along one side of the image recording medium and the third recording unit and the fourth recording unit being disposed in and along another side of the image recording medium.

18. The image forming device according to claim 17, wherein the first recording unit and the third recording unit are in confrontation with each other with said recording medium interposed therebetween, and the second recording unit and the fourth recording unit are in confrontation with each other with said recording medium interposed therebetween.

19. The image forming device according to claim 15, further comprising a fixing unit that thermally fixes the image recorded on the image recording medium.

* * * * *